United States Patent [19]

Ho

[11] Patent Number: 4,697,341

[45] Date of Patent: Oct. 6, 1987

[54] PROCESS TO MANUFACTURE CONTROL CABLE

[76] Inventor: Chien-Han Ho, P.O. Box 68-53, Taipei, Taiwan

[21] Appl. No.: 840,878

[22] Filed: Mar. 18, 1986

[51] Int. Cl.[4] ..... H01R 43/04

[52] U.S. Cl. ..... 29/871; 29/868; 56/52

[58] Field of Search ..... 29/868, 872, 871; 156/51, 52

[56] References Cited

U.S. PATENT DOCUMENTS 3,168,617 2/1965 Richter ..... 29/868 X 4,381,208 4/1983 Baverstock ..... 29/872 X

*Primary Examiner*—Timothy V. Eley

*Attorney, Agent, or Firm*—Lane and Aitken

[57] ABSTRACT

A process to manufacture control cable comprising feeding of a plurality of parallel conducting wires between an upper and a lower plastic films to be preheated in respective tunnel type heaters, and then formed and cooled by forming rolls, transferred by transmission rolls for cutting along gaps between two consecutive wires at appropriate pitch by roller cutters, the wires so processed are then twisted by a twisting machine, covered with metal foil first, and then braided copper network made by a braiding machine, and finally a PVC insulation layer by a PVC injection machine. The finished product is finally collected by a product collector.

12 Claims, 15 Drawing Figures

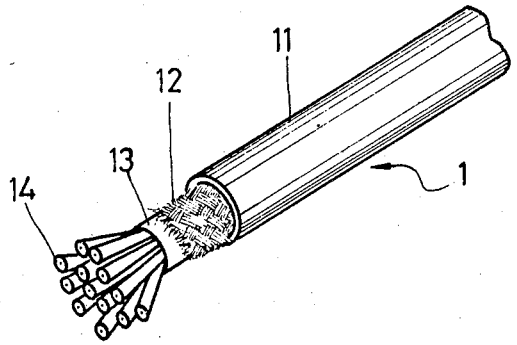
PRIOR ART Fig. 1
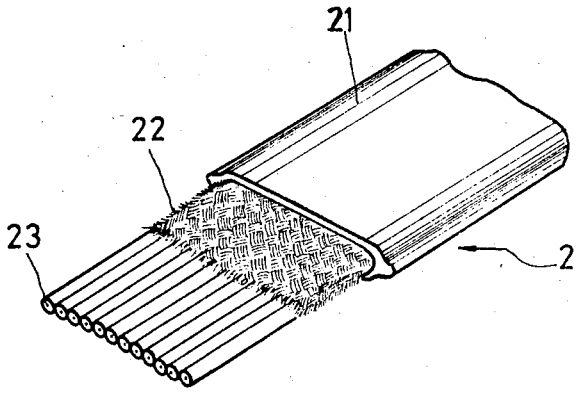
PRIOR ART Fig. 2

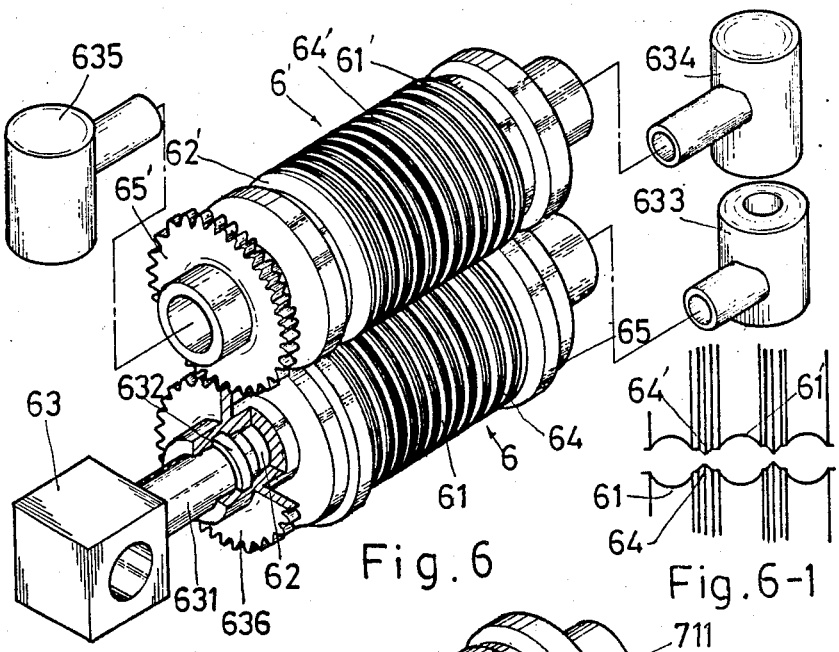
Fig. 6
Fig. 6-1
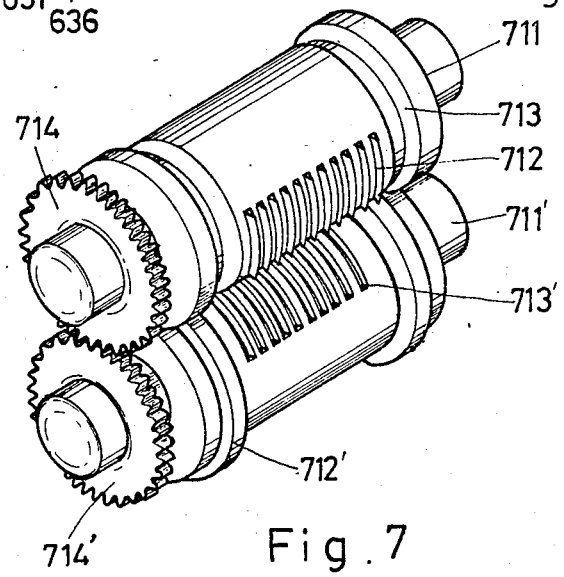
Fig. 7

PROCESS TO MANUFACTURE CONTROL CABLE

BACKGROUND OF THE INVENTION

The recent rapid progress in the electronic industry has expanded the scope of application of electronic devices. The invention of computers has simplified industrial processes and data processing. For communication between a host computer and its peripherals, control cable is a must. There are generally three kinds of control cables: Firstly, a plurality of conducting wires simply covered with a braided insulating network and metal foil which can isolate signals from each other excellently; secondly, a plurality of conducting wires simply covered with an insulated network; and thirdly, a single wire covered simply with a PVC layer. The above three kinds of control cables are used according to individual requirements. FIG. 1 illustrates structure of a common control cable. It is a conducting wire with a PVC insulation layer (11) as the outermost layer. It's second layer is a braided insulating network (12) and its third layer is an aluminum foil (13). It's cores are a plurality of conducting wires (14), the number of which depends on its application. Such a kind of control cable has the following disadvantages: (1) the conducting wires are not arranged in order, each wire is identified with a different color or stripe, and wires identified with a color may have different stripes so that identification of the wires is quite difficult; (2) soldering has to be done one by one, during which a wire may become loose or broken easily; (3) improper soldering may happen, and (4) soldering is slow. Therefore, ribbon cable has gradually replaced the common control cable. FIG. 2 illustrates a structure of a traditional ribbon cable. Its outermost layer is a flat PVC insulation layer (21), the second layer is a braided insulating network (22) and the core is a plurality of parallel wires (23). Since the wires (23) ae arranged flat in shape, the width of the cable will increase with increasing numbers of wires. Therefore, the traditional ribbon cable has three main defects: large ribbon cable makes storage inconvenient; (2) it is not suitable for long distance connection; and (3) it is not easy to penetrate the outermost PVC layer. In view of such defects, the inventor created a process to manufacture control cable.

SUMMARY OF THE INVENTION

The present invention provides a process to manufacture control cable. It is characterised by the feeding of a plurality of parallel conducting wires in equidistance between an upper plastic film and a lower plastic film to be preheated by a tunnel type heater. The preheated films are then adhered and enclose the conducting wires by forming rolls which can do pressing, cooling and cutting along gaps between each two consecutive wires simultaneously. The wires are then moved by transmission rolls and cooled by fans. A roller cutter is used to cut and separate the wires at appropriate pitch, a twisting machine is used to twist the wires, and then, a covering machine is used to cover the twisted wires with metal foil. A braiding machine makes a braided insulating network to cover them and a PVC injection machine is used to apply a layer of PVC on the wires. The finished cable is finally collected by a product collector.

BRIEF DESCRIPTION OF THE DRAWINGS

FIG. 2 shows structure of a traditional ribbon cable.

FIG. 3-1 shows another control cable made with the process according to the present invention.

FIG. 6 shows structure of the forming rolls according to the present invention.

FIG. 6-1 is a partial sectional view of the forming rolls.

FIG. 7 shows structure of the roller cutter according to the present invention.

FIG. 8-1 is a partial sectional view illustrating relationship between the upper forming roll.

DETAILED DESCRIPTION OF THE PREFERRED EMBODIMENT

Figure 3:
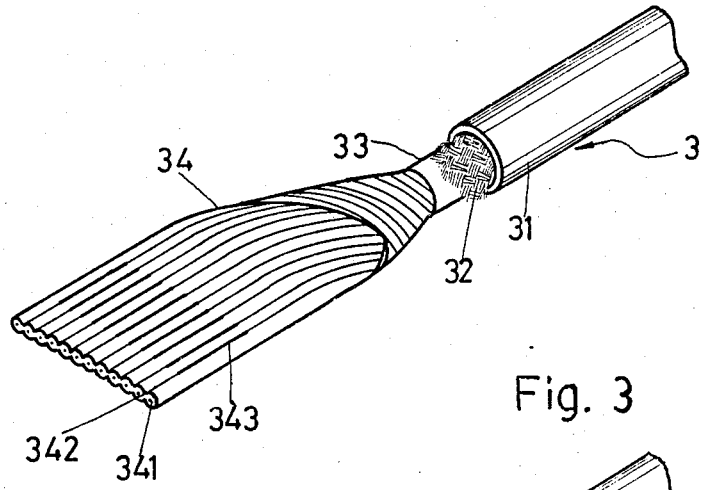
FIG. 3 shows a control cable made with the process according to the present invention.
Figures 1, 3:
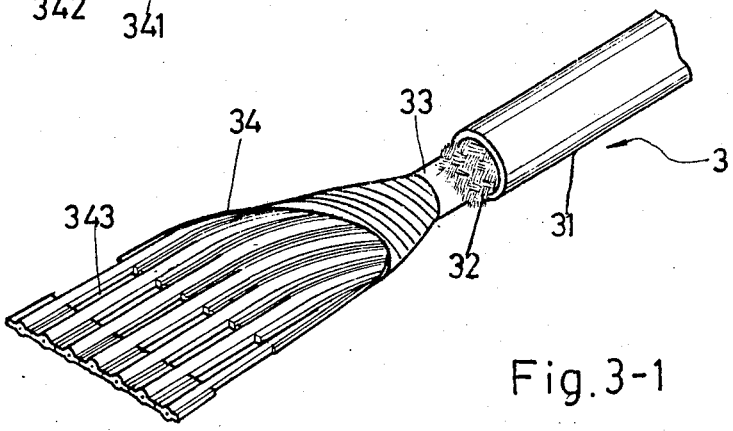
FIG. 1 shows structure of a common control cable.

FIG. 3 and FIG. 3-1 illustrate structure of products according to the present invention. As shown in the drawings, the outermost layer is a PVC insulation layer (31), the second layer is a braided wire (32), the third layer is a metal foil layer (33) and the fourth layer is a ribbon cable (34). There are two kinds of ribbon cable (34) according to the present invention: one in the form of separated conductive wires with appropriate cutting (343) between every two consecutive wires for a small pitch (342) between every two consecutive wires, (FIG. 3) and another in the form of wires with cutting made by means of punching at set positions for a large pitch (342) between every two consecutive wires (FIG. 3-1). The manufacturing process for the ribbon cable 34 is described below.

Figure 4:
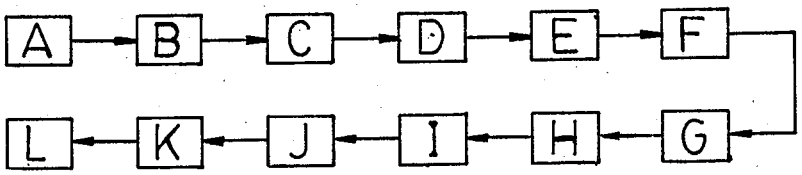
FIG. 4 is a block diagram illustrating the process according to the present invention.

FIG. 4 is a block diagram illustrating a manufacturing process according to the present invention, as follows:

A-Conducting wires are guided, collected and led to a product collector;

B-A plurality of wires is made running parallel with a predetermined pitch;

C-Two rolls of plastic film are led in parallel with the conducting wires, one above and the other beneath the wires, and extending to the product collector;

D-The upper and lower plastic films are brought into a tunnel type heater for preheating evenly;

E-The preheated plastic films are heated, and then pressed and cooled by forming rolls so that the upper and lower films, as well as the conducting wires, are integrated, a groove is formed at each pitch between every two consecutive conducting wires, and a surface pattern is finished;

F-The conducting wires are pulled by transmission rolls in order to reduce the load on the forming rolls, and then the conducting wires are cooled to make their final form;

G-A roller cutter is used to cut along each pitch, or, if the pitch between every two consecutive wires is large, a punch is used to cut the appropriate portion of the upper and lower plastic films at an appropriate pitch;

H-A twister is used to twist the flat ribbon cable;

I-A covering machine is used to cover the twisted cable with metal foil;

J-A braiding machine is used to braid a copper wire netting to cover the metal foil wrapping the cable;

K-A PVC injection machine is used to coat a PVC layer on the cable; and

L-the cable so formed is kept cool and collected at the product collector.

Figure 5:
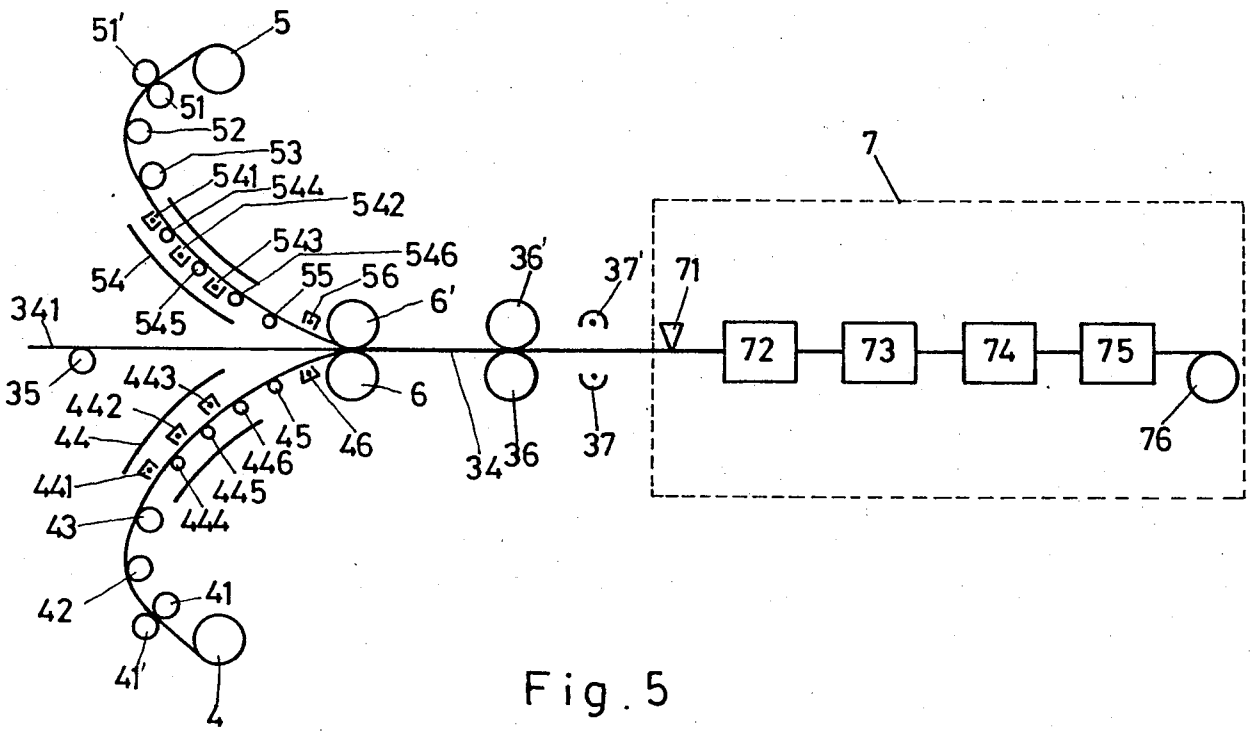
FIG. 5 is a schematic illustration of apparatus used in performing the process according to the present invention.

FIG. 5 schematically illustrates apparatus for performing the process according to the present invention.

The process can be divided into two stages, the first for ribbon cable and the second for PVC covered cable.

As shown in FIG. 5, conducting wires (341), which have their weight supported by a roll (35), are delivered to the forming rolls (6) and (6'). There can be several, several decades or more than one hundred parallel wires (341), to be determined upon actual requirements, arranged in equidistance. The parallel wires (341) are placed between an upper plastic film (5) and a lower plastic film (4). The lower plastic film (4) is extended from a roll by the drive rollers (41) and (41'). It is supported by the rollers (42) and (43) and then led to a tunnel type heater (44) with a plurality of heating elements. The description herein refers to an embodiment with three heating elements (441), (442) and (443). Normally PVC or PE film is used. A direct heating to its melting point is not recommended. It must be preheated to a set temperature; otherwise, it may be burnt. Generally, the preheating temperature is about 60°-100° C. Different preheating temperatures must be set for different materials, and the preheating temperature for the present invention is adjustable. Since the film (4) will be softened during the preheating, rolls (444), (445) and (446) are used to support the film (4) in order to prevent excessive tension in the film (4) and permit the film to move along its way. The direction of preheating the film (4) in the present invention is different from the traditional one. It is a preheating for adhesion between the film (4) and the film (5). Both of them are then directed by the roller (45) for direct heating. The films (4) and (5) are placed symmetrically. There are transmission rolls (51) and (51'), rollers (52) and (53) and a tunnel type heater (54) for the film (5). The tunnel heater (54) has heating elements (541), (542) and (543) for heating at the bottom. Rollers (544), (545) and (546) are used to support the film (5) before the film (5) adheres to the film (4) in order to prevent uneven heating by the heating elements (541), (542) and (543), and to permit the film (5) to move along its way from the roller (55) to the forming rolls (6) and (6'). Tunnel type heaters (44) and (54) with fans within the heaters permit even heat distribution in these tunnels so that the plastic films (4) and (5) can be heated evenly with less heat energy loss for energy conservation purposes. If the preheating temperature is not high enough, the present invention can be equipped with additional direct heaters (46) and (56) for directly heating before the forming rolls (6) and (6') apply a pressure for forming.

FIG. 6 shows a structure of the forming rolls. FIG. 6-1 is a partial sectional view of the forming rolls. The forming rolls (6) and (6') are made of metal. Each of them has a plurality of grooves (61) for the parallel wires. A pin or ridges (64) or (64') is made in the middle of each gap between two consecutive grooves (61) to cut a groove (14) in the middle of each gap between two consecutive wires which have been covered with the heated plastic films (4) and (5). The forming roll (6) has a cooling water inlet (63) at its shaft (62) to maintain the temperature of the forming roll (6) at about 50°-130° C. Therefore, the forming roll (6) provides a cooling effect. Since the wires (1) covered with the plastic films (4) and (5) are fed to the forming rolls (6) and (6') straight, the forming rolls (6) and (6') do not only apply a pressure to form the cable, but also finish its surface pattern and cool it in a single step. The production speed is fast, and the quality is advanced.

The cooling water inlet (63) permits a water pipe (631) to enter the shaft (62). It has a gasket (632) to prevent back flow of cooling water. Cooling water flows out from another end of the shaft (62) and then enters, via another inlet (634), the shaft of the upper forming roll (6'). It leaves the upper forming roll (6') from another end of the shaft to form a circulating cooling water system.

The upper and lower forming rolls (6) and (6') have gears (636) and (651) for synchronous rotation with minimum driving force.

The direct heaters (46) and (56) shown in FIG. 5 may be omitted if the plastic films (4) and (5) can reach a sufficient preheating temperature. Additional heaters should be installed for special or thick plastic film.

The plastic films (4) and (5) are preheated at their respective contact surfaces so that adhesion between plastic films of different properties is possible. The conducting wires (1) are not heated in the preheating process. Their low temperature will avoid overheating, and expansion or contraction while they are covered by the plastic films (4) and (5). The plastic films (4) and (5) are fed in a straight tape. Their tension can be controlled easily, and breaking of the films (4) and (5) due to excessive or insufficient tension can be avoided.

The forming rolls (6) and (6') are driven by the transmission rolls (36) and (36') in order to reduce pulling force against the forming rolls (6) and (6'). Parallel cable from the forming rolls (6) and (6') is at about 50°-120° C. While it is twisted by the twisting machine (72), the cable will reform while it is cooled by cooling fans (37) and (37'). After such cooling, a roller (71) is used to cut it at every gap between two consecutive wires (341) to form a shape as shown in FIG. 3 so that after being twisted, the flexibility of wires (341) is maintained.

After being twisted at the twisting machine (72), the wires (1) are covered again with metal foil (33) by means of a covering machine (73). Then, a braiding machine (74) is used to braid an insulation network (32) to cover the wires (1). Finally, a PVC injection machine (75) is used to place a PVC insulation layer (31) on the braided network (32), and the finished product is collected at a product collector (76) in roll.

FIG. 7 shows a structure for the roller (71). There are a plurality of parallel cutters (712) on the roll (711). The cutters (712) are arranged in equidistance in a manner that each cutter (712) corresponds to each gap (342) between two consecutive wires (341). Rotation of the roll (711) can cut the gaps (342) properly. There are an upper roll (711) and a lower roll (711') to enable the cutters (712) to align with the gaps (342). The cutters (712) are made on the upper roll (711), which has matching grooves (713) to match with the matching rings (712') on the lower roll (711'). Gears (714) and (714') are used to permit synchronous rotation and to prevent lateral displacement of the upper and lowr rolls (711) and (711'). In operation, the cutters (712) must be aligned with each respective corresponding receptacle (713') on the lower roll (711') for proper cutting. Of course, a series of rollers (71) may be used instead of the single set of rollers described above, with timing control to cut at set pitch.

Figure 8:
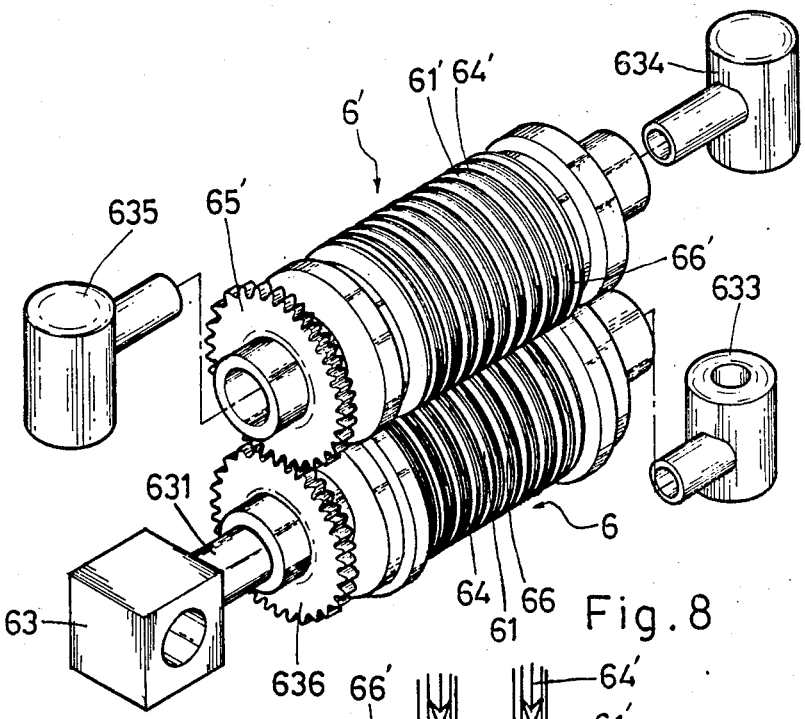
FIG. 8 shows structure of another forming rolls according to the present invention.
Figures 1, 8:
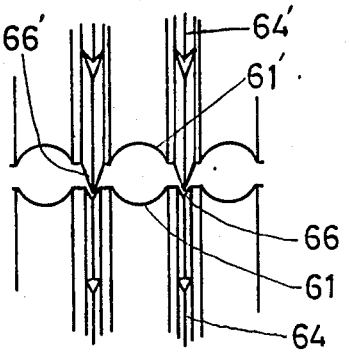

FIG. 8 shows an alternative structure of the forming rolls. They have their cutters (66') placed on the upper forming roll (6'). That is, the upper forming roll (6') has cutters (66') above the pins or ridges (64') so that the forming rolls can cut the wires at appropriate pitch in addition to their functions of forming, surface patterm finishing and cooling.

FIG. 8-1 is a partial sectional view illustrating the relationship between the upper forming roll, the lower forming roll (6) and cutters (66'). The cutters (66') on the upper forming roll (6') are just within their corresponding receptacles on the lower forming roll (6), in the of grooves (66) for cutting at appropriate pitch.

With reference to FIG. 8, the tolerance for parallel wires formed by the forming rolls must be very small. In brief, if the tolerance for each pitch (due to temperature or any other factor during the forming process) is 0.005 mm, then, for a cable with 60 conducting wires, the aggregate tolerance will be 0.3 mm, which is far beyond the current allowable tolerance of 0.1 mm, and product therefrom will not be adaptable to adaptors available in the market. Therefore, a cooling system for the forming rolls (6) and (6') is absolutely necessary to avoid influence due to great difference in temperature. Moreover, rotation of the upper and lower forming rolls (6) and (6') must be within a tolerance of 0.02 mm. For this purpose, the upper forming roll (6') has a left lug (61') and a right lug (62'), each with a depth slightly deeper than the fnslhes (65) and (66) so that the pitch between two consecutive wires (1) is very small and the tolerance is very small too.

Figure 9:
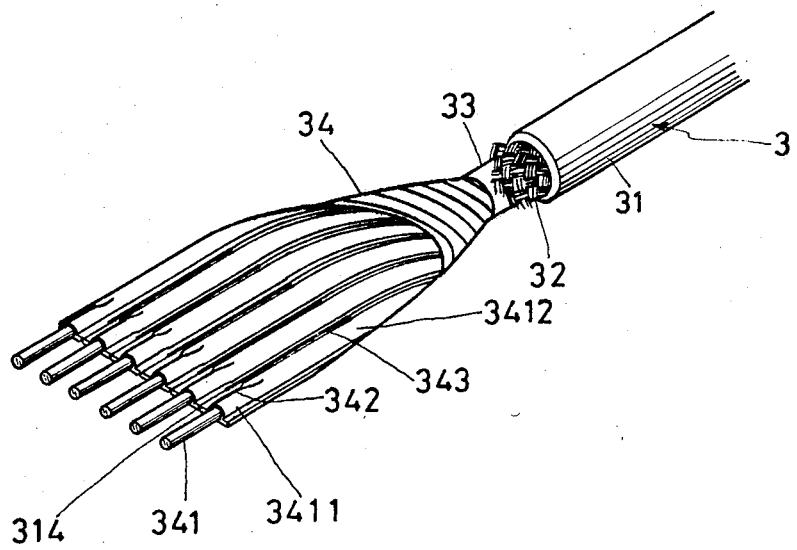
FIG. 9 is a perspective view of still another control cable made by the process according to the present invention.

FIG. 9 is a perspective view of another embodiment according to the present invention. As shown in the drawing, the outermost layer of the cable is an insulated coating (31), the second layer us a braided wire (32), the third layer is a metal foil (33), and the fourth layer is a wound ribbon cable (34) with a gap (343) at each pitch (341) between every two conductive wires (341) of the cable (34). In application, the cable (34) can be torn at any gap (344) for any number of conductive wires (341) required. The conductive wires (341) according to the present invention are partly in the form of round wire (3411) and partly in the form of flat wire (3412). An opening cut by a tool is formed at the flat wire (3412) to enhance flexibility of the cable after it is wound.

Figure 10:
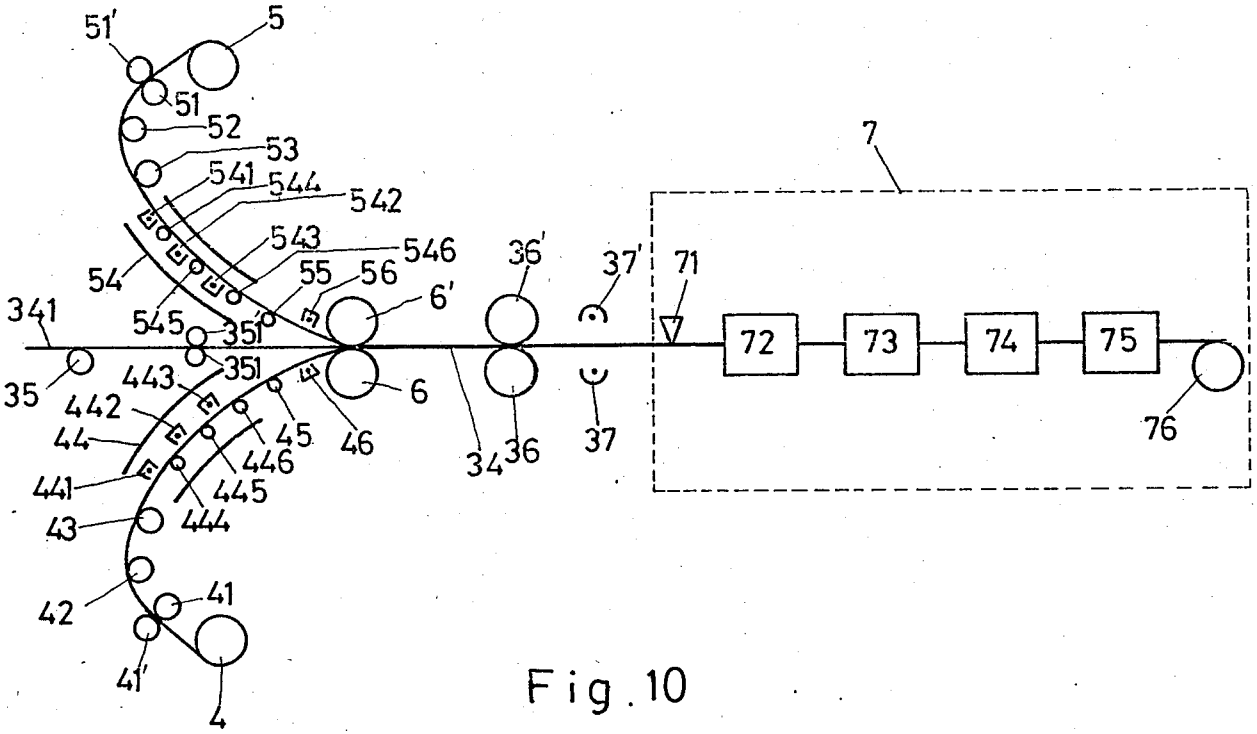
FIG. 10 is a schematic illustration of other apparatus used in performing the process according to the present invention.

FIG. 10 illustrates another embodiment according to the present invention. It is substantially similar to that shown in FIG. 5. The only difference between them is that the former has a pair of rollers (351) and (351') after the roll (35) for the conductive wires (341) for intermittent or continuous rolling over the conductive wires as desired to form a cable with partly round wire (3411) and partly flat wire (3412), or fully flat wire (3411). The conductive wires (341) so formed are then coated with preheated plastic films (4) and (5) on the top and bottom respectively and formed again by the rolls (6) and (6'), which are identical to those in FIG. 5 and are not described here.

Figure 11:
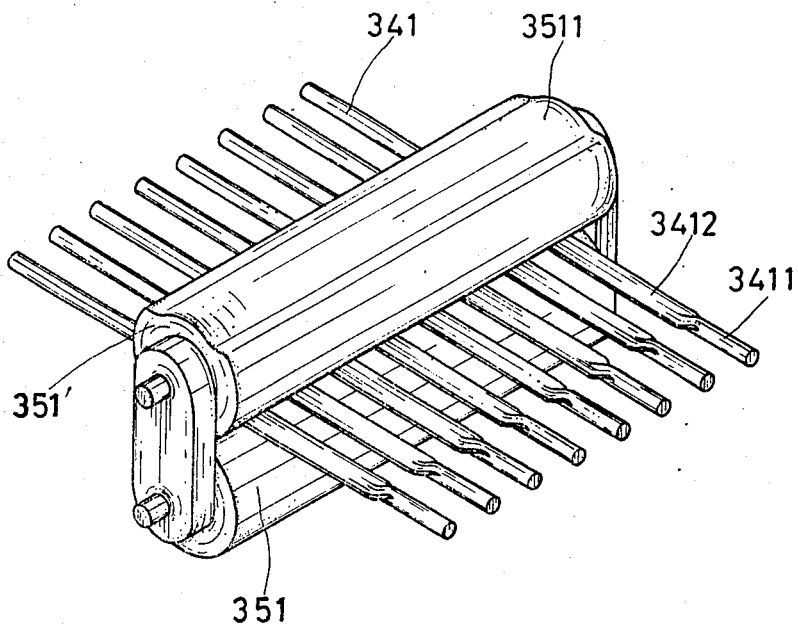
FIG. 11 is a perspective view of one embodiment of rolls for forming the conductive wires in the process according to the present invention.
Figure 12:
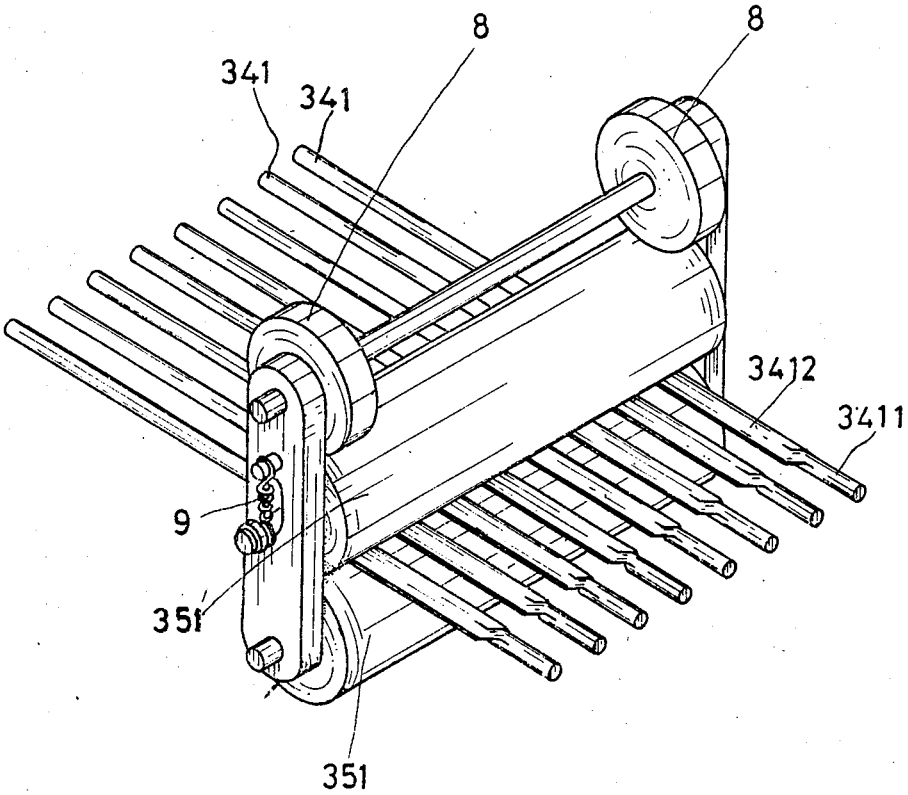
FIG. 12 is a perspective view of another embodiment of rolls for forming the conductive wires in the process according to the present invention.

There are three kinds of forming rolls according to the present invention: (1) those as shown in FIG. 11, which have a plurality of sections having a diameter equal to the diameter of the roll (351) or (351') so that the conductive wires will have some flat portions (3412) after passing between the rolls (351) and (351'), and some round portions (3411) which pass between sections (3511) of the rolls (351) and (351') having a reduced diameter; (2) those as shown in FIG. 12 with an eccentric wheel (8) and a spring (9) for intermittent rolling; and those incorporating a control circuit with a hydraulic circuit for intermittent rolling.

I claim:

1. A process to manufacture control cable comprising the steps of:
   (a) moving a plurality of conducting wires in parallel to a product collector, with a predetermined pitch between said wires;
   (b) feeding films of plastic in parallel with said conducting wires, one film moving above the conductive wires and another film moving below said conducting wires, the films extending to the product collector;
   (c) preheating the plastic films in a tunnel-type heater;
   (d) heating the preheated plastic films, integrating the upper and lower plastic films around said conducting wires and forming a groove between each two consecutive conducting wires by pressing and cooling said films with forming rolls in order to form a flat ribbon cable;
   (e) pulling said conducting wires by means of transmission rolls in order to reduce the load on the forming rolls;
   (f) cutting the films between each two wires;
   (g) twisting the flat ribbon cable;
   (h) covering the twisted cable with metal foil;
   (i) covering the metal foil with a wire braid;
   (j) coating the wire braid with a polyvinylchloride layer; and
   (k) collecting the cable at the product collector.

2. The process to manufacture control cable as claimed in claim 1, wherein the step of cutting the plastic films between each two consecutive wires comprises punching slots in said films between each two conseuctive wires.

3. The process to manufacture control cable as claimed in claim 1, wherein the step of preheating includes moving said webs through the tunnel-type heaters by means of transmission rolls in the tunnel-type heaters and evenly distributing the heat by means of fans.

4. The process to manufacture control cable as claimed in claim 1, wherein step (d) comprises cooling, pressing and surface pattern finishing the plastic films by means of interengaging receptacles and pins on the forming rolls.

5. The process to manufacture control cable as claimed in claim 1, wherein a cooling liquid is passed through the forming rolls.

6. The process to manufacture control cable as claimed in claim 1, wherein step (f) comprises providing evenly spaced cutters on the cutter roller and aligning said evenly spaced cutters with gaps between each two conducting wires.

7. The process to manufacture control cable as claimed in claim 6, wherein the step of cutting comprises cutting by means of two cutter rollers, one of said cutter rollers engaging one film of plastic and the other of said cutter rollers engaging the other film of plastic, and maintaining proper alignment of the cutters between the conductive wires by providing one of said cutter rollers with at least one circumferentially projecting ring and the other of said rollers with a circumferential groove mating with said circumferentially projecting ring.

8. The process to manufacture control cable as claimed in claim 1, wherein step (f) is performed by a cutter roller.

9. The process to manufacture control cable as claimed in claim 1, wherein steps (d) and (f) are performed by forming rolls having cutters.

10. The process to manufacture control cable as claimed in claim 1, further comprising intermittently rolling the conductive wires to form wires having alternating flat portions and round portions.

11. The process to manufacture control cable as claimed in claim 1, wherein the conductive wires are rolled flat.

12. The process to manufacture control cable as claimed in claim 1, wherein step (d) is performed by grooves and ridges on the forming rolls, the grooves being spaced at an appropriate pitch for passing the conductive wires, and a ridge positioned between each two consecutive grooves of the forming rolls for forming the groove between each two conducting wires.

* * * * *